US011299301B2

(12) United States Patent
Nash et al.

(10) Patent No.: US 11,299,301 B2
(45) Date of Patent: Apr. 12, 2022

(54) FLOOR JACK WITH TEMPORARY SHIPPING HANDLES AND PACKAGING THEREFOR

(71) Applicant: Snap-on Incorporated, Kenosha, WI (US)

(72) Inventors: Derek Nash, Greer, SC (US); Eian Mathieson, St. Ives (AU); Robert Fox, Greenville, SC (US); Matt Larson, Mauldin, SC (US)

(73) Assignee: Snap-on Incorporated, Kenosha, WI (US)

( * ) Notice: Subject to any disclaimer, the term of this patent is extended or adjusted under 35 U.S.C. 154(b) by 182 days.

(21) Appl. No.: 16/050,554

(22) Filed: Jul. 31, 2018

(65) Prior Publication Data

US 2018/0334270 A1 Nov. 22, 2018

Related U.S. Application Data

(62) Division of application No. 14/223,470, filed on Mar. 24, 2014, now Pat. No. 10,144,538.
(Continued)

(51) Int. Cl.
*B65B 5/04* (2006.01)
*B65B 29/00* (2006.01)
(Continued)

(52) U.S. Cl.
CPC ..... *B65B 5/04* (2013.01); *B65B 29/00* (2013.01); *B65B 55/20* (2013.01); *B65B 69/00* (2013.01);
(Continued)

(58) Field of Classification Search
CPC ..... B65D 2585/641; B65D 2585/649; B65D 2585/686; B65D 2585/689;
(Continued)

(56) References Cited

U.S. PATENT DOCUMENTS 2,068,095 A 1/1937 Weltzien
2,238,166 A 4/1941 Gagen
(Continued)

FOREIGN PATENT DOCUMENTS

EP 0839728 A1 * 5/1998 ..... B65D 5/4608
JP 05132080 A * 5/1993
WO WO-2012128766 A1 * 9/2012 ..... B65D 81/058

OTHER PUBLICATIONS

"Powerfist—Low Pro Floorjack—Unboxing", Published Feb. 28, 2013; https://www.youtube.com/watch?v=ZJRsC_J71c, accessed Feb. 8, 2018.

(Continued)

*Primary Examiner* — Joshua G Kotis
(74) *Attorney, Agent, or Firm* — Seyfarth Shaw LLP

(57) ABSTRACT

This invention is directed towards the packaging of heavy articles such as floor jacks and similar equipment. The package is adapted to allow a heavy article to be rolled out of the package without lifting. The packaging is designed to engage with temporary handles positioned on the packaged article to make it easier for an end user to maneuver the packaged article and to remove the article from the packaging.

4 Claims, 12 Drawing Sheets

Related U.S. Application Data

(60) Provisional application No. 61/804,329, filed on Mar. 22, 2013.

(51) Int. Cl.

| | |
|---|---|
| ***B65B 55/20*** | (2006.01) |
| ***B65D 85/68*** | (2006.01) |
| ***B65D 5/46*** | (2006.01) |
| ***B65D 85/64*** | (2006.01) |
| ***B65B 69/00*** | (2006.01) |
| ***B65D 5/50*** | (2006.01) |
| ***B65D 5/42*** | (2006.01) |

(52) U.S. Cl.
CPC ..... *B65D 5/4204* (2013.01); *B65D 5/46008* (2013.01); *B65D 5/509* (2013.01); *B65D 5/5047* (2013.01); *B65D 85/68* (2013.01); *B65D 85/64* (2013.01); *B65D 2585/6875* (2013.01); *B65D 2585/6897* (2013.01)

(58) Field of Classification Search
CPC ..... B65D 2585/6897; B65D 85/64; B65D 85/68; B65D 85/70; B65D 25/30; B65D 25/54; B65D 5/38; B65D 5/4204; B65D 5/4208; B65D 5/4608; B65D 5/46192; B65D 5/64; B65D 5/643; B65D 5/646; B65D 5/68; B65D 5/685; B65D 81/051; B65D 81/052; B65D 77/042; B65D 5/46032; B65D 5/4604; B65D 5/46008; B65D 5/46024; B65D 5/46048; B65D 5/46056; B65D 2571/0045; B65B 55/20; B65B 29/00; B65B 69/00; B65B 61/14; B65B 61/16; B25H 3/006
USPC ..... 53/594, 382.1; 229/117.13–117.18, 229/117.24, 117.25, 121, 162.1, 117.09, 229/117.11, 117.22, 117.23; 206/772–774, 738–739, 746, 766, 763, 206/779, 780, 782, 783, 590, 521
See application file for complete search history.

(56) References Cited

U.S. PATENT DOCUMENTS

| | | | | | |
|---|---|---|---|---|---|
| 2,299,355 | A | | 10/1942 | Stolpman | |
| 2,591,593 | A | * | 4/1952 | Nolan | B65D 5/48038 229/117.09 |
| 2,774,475 | A | * | 12/1956 | Morken | B65D 5/5061 206/321 |
| 2,954,901 | A | * | 10/1960 | Winstead | B65D 77/065 222/183 |
| 3,015,430 | A | | 1/1962 | Bauer | |
| 3,036,704 | A | * | 5/1962 | Meisenheimer | B65D 5/46024 206/143 |
| 3,058,583 | A | * | 10/1962 | Williams | B65D 5/4208 206/425 |
| 3,093,291 | A | * | 6/1963 | Brandle | B65D 5/304 229/192 |
| 3,181,836 | A | | 5/1965 | Arnes et al. | |
| 3,192,680 | A | * | 7/1965 | Mantell | B65D 77/02 53/449 |
| 3,193,152 | A | * | 7/1965 | White, Jr. | B65D 85/64 222/182 |
| 3,286,910 | A | | 11/1966 | Offenburger | |
| 3,338,503 | A | | 8/1967 | Bruce | |
| 3,499,582 | A | * | 3/1970 | Sheldon | B65D 77/0426 222/183 |
| 3,514,922 | A | | 6/1970 | Depass | |
| 3,891,137 | A | | 6/1975 | Ellison | |
| 3,929,225 | A | | 12/1975 | Locke | |
| 4,008,847 | A | | 2/1977 | Davis | |
| 4,032,009 | A | * | 6/1977 | Taylor | B65D 5/16 206/321 |
| 4,133,428 | A | | 1/1979 | Gloyer | |
| 4,391,367 | A | | 7/1983 | Perego | |
| 4,715,493 | A | | 12/1987 | Dreyfus | |
| 4,828,115 | A | * | 5/1989 | Wiegand | B65D 81/113 206/319 |
| 4,832,355 | A | | 5/1989 | Hung | |
| 4,852,756 | A | | 8/1989 | Holladay | |
| 4,871,068 | A | * | 10/1989 | Dreyfus | B65D 5/2033 206/428 |
| 4,934,126 | A | | 6/1990 | Wiegand et al. | |
| 5,385,293 | A | | 1/1995 | Hirota | |
| 5,492,270 | A | * | 2/1996 | Avery | B65D 77/062 229/117.24 |
| 5,562,227 | A | * | 10/1996 | Takezawa | B65D 5/5021 229/117.13 |
| 5,626,380 | A | | 5/1997 | Elson et al. | |
| 5,941,384 | A | | 8/1999 | Schonhardt | |
| 6,045,036 | A | | 4/2000 | Ring | |
| 6,073,760 | A | | 6/2000 | Roemer et al. | |
| 6,128,889 | A | | 10/2000 | Fuss | |
| 6,199,693 | B1 | | 3/2001 | Hung | |
| 6,332,554 | B1 | | 12/2001 | McCarthy | |
| 6,352,199 | B1 | * | 3/2002 | Gardner | B65D 5/323 229/122.24 |
| 6,357,724 | B1 | * | 3/2002 | Hung | B66F 5/00 254/8 B |
| 6,848,673 | B1 | * | 2/2005 | McLaughlin, Sr. | B66F 5/00 254/8 B |
| 6,908,131 | B2 | * | 6/2005 | Main | A61G 7/1023 294/150 |
| 7,419,055 | B2 | * | 9/2008 | Manuel | B65D 81/113 206/320 |
| 7,661,777 | B2 | | 2/2010 | Ceccarelli et al. | |
| 7,775,225 | B2 | | 8/2010 | Wade | |
| 8,459,449 | B2 | | 6/2013 | Justice et al. | |
| 2003/0136951 | A1 | | 7/2003 | Hung | |
| 2004/0094448 | A1 | * | 5/2004 | Koike | B65D 5/5088 206/521 |
| 2004/0222127 | A1 | * | 11/2004 | McLeod | B65D 5/4204 206/736 |
| 2004/0232021 | A1 | | 11/2004 | Linton | |
| 2005/0040379 | A1 | | 2/2005 | Hung | |
| 2005/0076618 | A1 | | 4/2005 | Powers | |
| 2006/0000746 | A1 | | 1/2006 | Ma | |
| 2008/0022462 | A1 | | 1/2008 | Benson | |
| 2009/0071991 | A1 | | 3/2009 | Evans | |
| 2010/0258775 | A1 | | 10/2010 | Zhengwei | |
| 2011/0048990 | A1 | * | 3/2011 | Goda | B65D 81/056 206/386 |
| 2011/0140329 | A1 | * | 6/2011 | Mandody | B66F 3/36 269/30 |
| 2011/0193035 | A1 | | 8/2011 | Kania | |
| 2011/0266335 | A1 | * | 11/2011 | Glowacki | B65D 5/425 229/103.2 |
| 2012/0097569 | A1 | * | 4/2012 | Murano | B65D 77/04 206/523 |
| 2012/0267385 | A1 | * | 10/2012 | Scott | B65D 5/4608 220/770 |
| 2012/0318710 | A1 | | 12/2012 | McIntosh | |
| 2014/0034543 | A1 | * | 2/2014 | Grubstein | B65D 77/02 206/523 |
| 2014/0124567 | A1 | * | 5/2014 | Ulibarri | B65D 5/5475 229/117.09 |

OTHER PUBLICATIONS

"Floorjack unbox", Published Sep. 24, 2013, https://www.youtube.com/watch?v=p78EZ8in2nE, accessed Feb. 8, 2018.

* cited by examiner

FLOOR JACK WITH TEMPORARY SHIPPING HANDLES AND PACKAGING THEREFOR

CROSS REFERENCES TO RELATED APPLICATIONS

This application is a divisional of and claims the benefit of U.S. application Ser. No. 14/223,470, filed on Mar. 24, 2014, entitled Floor Jack with Temporary Shipping Handles and Packaging Therefor, which claims the benefit of U.S. Provisional Application Ser. No. 61/804,329 filed on Mar. 22, 2013, the contents of which are incorporated herein by reference in their entirety.

FIELD OF THE INVENTION

This invention is directed towards the packaging of heavy articles such as floor jacks and similar equipment. The package is adapted to allow a heavy article to be rolled out of the package without lifting. The packaging is designed to engage with temporary handles positioned on the packaged article to make it easier for an end user to maneuver the packaged article and to remove the article from the packaging.

BACKGROUND OF THE INVENTION

This invention relates to packaging for heavy items such as service jacks, tools, and heavy weight articles that are difficult for a single person to carry and maneuver. While it is known in the art to provide handles within paperboard or corrugated packaging, the stress of a heavy article on a perforated tab or cut-out handle can easily exceed the tear strength of the packaging. At times, packaging thickness and cost is increased to provide for a more tear resistant package at the formed handle location.

An additional problem of packaging of heavy articles is that the end removal by the consumer often requires a "dead weight" lift of a heavy article be done to remove it from the packaging. In some instances, damage to the underlying article can occur or injury to the consumer can occur if the wrong portion of a packaged article is grasped and used to manipulate the item from the packaging. Accordingly, there is room for variation and improvement within the art.

SUMMARY OF THE INVENTION

It is one aspect of at least one embodiment of the present invention to provide for a corrugated or paperboard packaging having openings there through in which temporary handles placed on a heavy object can be accessed to facilitate movement of the package as well as the removal of the items from the packaging.

It is a further aspect of at least one embodiment of the present invention to provide for heavy articles such as a floor jack, to be equipped with temporary handles which can be accessed through the packaging to help maneuver the packaging. The position of the handles which is inboard from the outer walls of the packaging also provides a more ergonomic lifting position.

It is a further aspect of at least one embodiment of the present invention to provide for temporary handles on heavy equipment such as a floor jack that facilitates removal of the floor jack from the shipping carton. Following removal from the carton, the temporary handles can be removed from the floor jack.

It is a further aspect of at least one of the present embodiments of the invention to provide for packaging for a floor jack or other heavy item in which perforated tabs can be provided to allow access to handles positioned beneath the tabs which can be used to transport the package without placing the entire packaged weight on the paperboard packaging.

It is a further and more particular object of at least one aspect of the current invention to provide for a shipping container of paperboard or corrugated paper which avoid the use of external straps as handles or hold fast for manipulating the article.

It is a further aspect of at least one embodiment of the present invention to provide for a telescopic corrugated container construction in which an upper half of a telescopic container can be removed thereby providing access to temporary handles which are disposed on a heavy weight item. Handles can be used to safely lift the heavy article from the packaging.

It is a further object of at least one aspect of the present invention is to provide for a shipping container in which a lower half of the container can be unfolded or separated along perforation lines such that an edge wall can be disengaged from the remainder of the container. A Foam insert that protects the product can be slid out of the container and by the use of temporary handles, the product can be slid out of the packaging more easily without risking damage to the packaged article by consumer inadvertently grabbing or applying or heavy force to a part that could cause injury to the consumer or damage to the equipment.

It is a further aspect of at least a one embodiment of the present invention to provide for an article of heavy equipment, such as a floor jack, that has temporary handles constructed from plastic, rope, webbing material, wire or metal strap which are connected to structurally sound and secure locations of the article. Following removal of the article from the packaging, the temporary handles can be permanently removed from the item.

An additional aspect of at least one embodiment of the present invention is to provide for a paper based packaging that has accessible openings for engagement of temporary handles positioned on the packaged article. Temporary articles can be accessed and used to manipulate the packaging for storage, inventory, and point of sale displays. Following manipulation of the packaging, the handles can be repositioned within the packaging until further needed.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Figure 1:
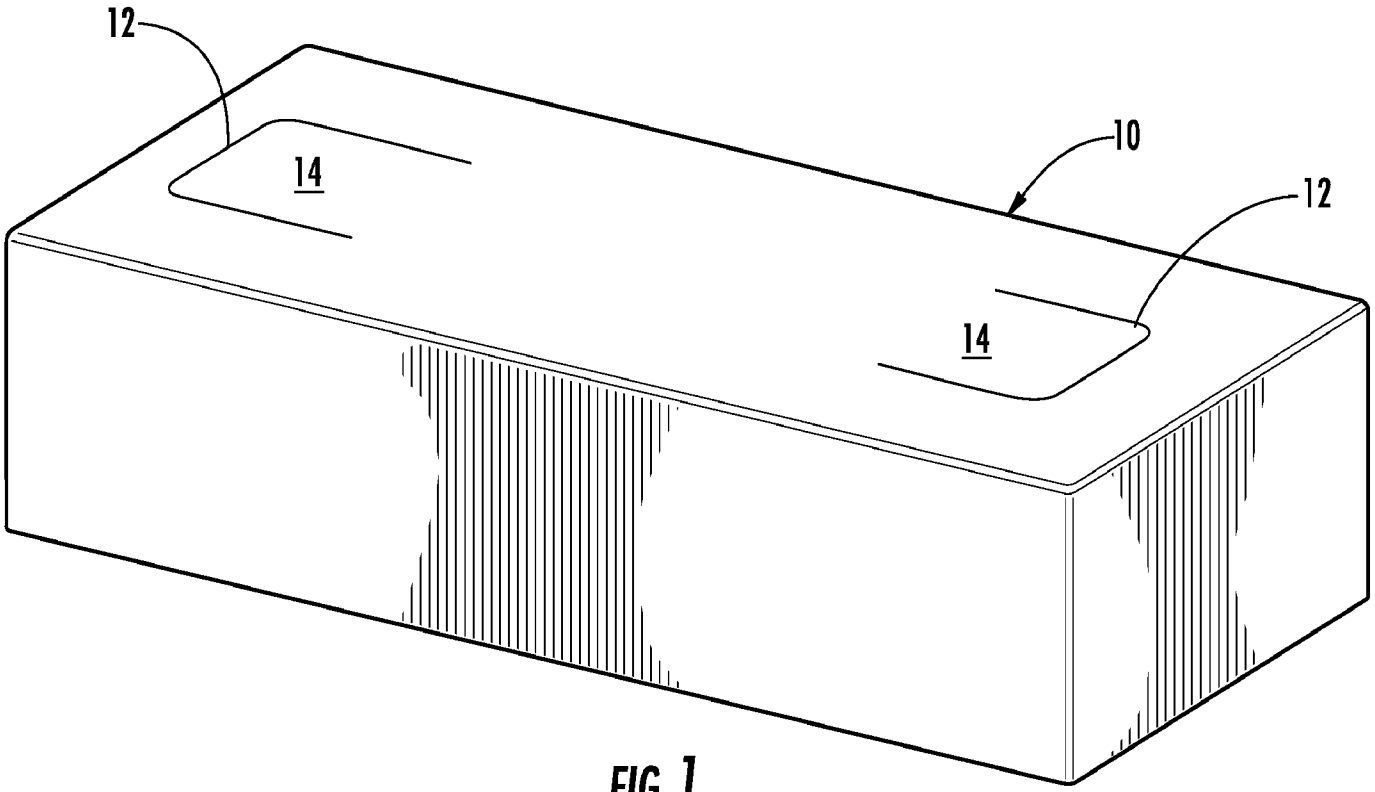
FIG. 1 is a perspective view of a corrugated package having perforations on an upper surface of the package container.
Figure 2:
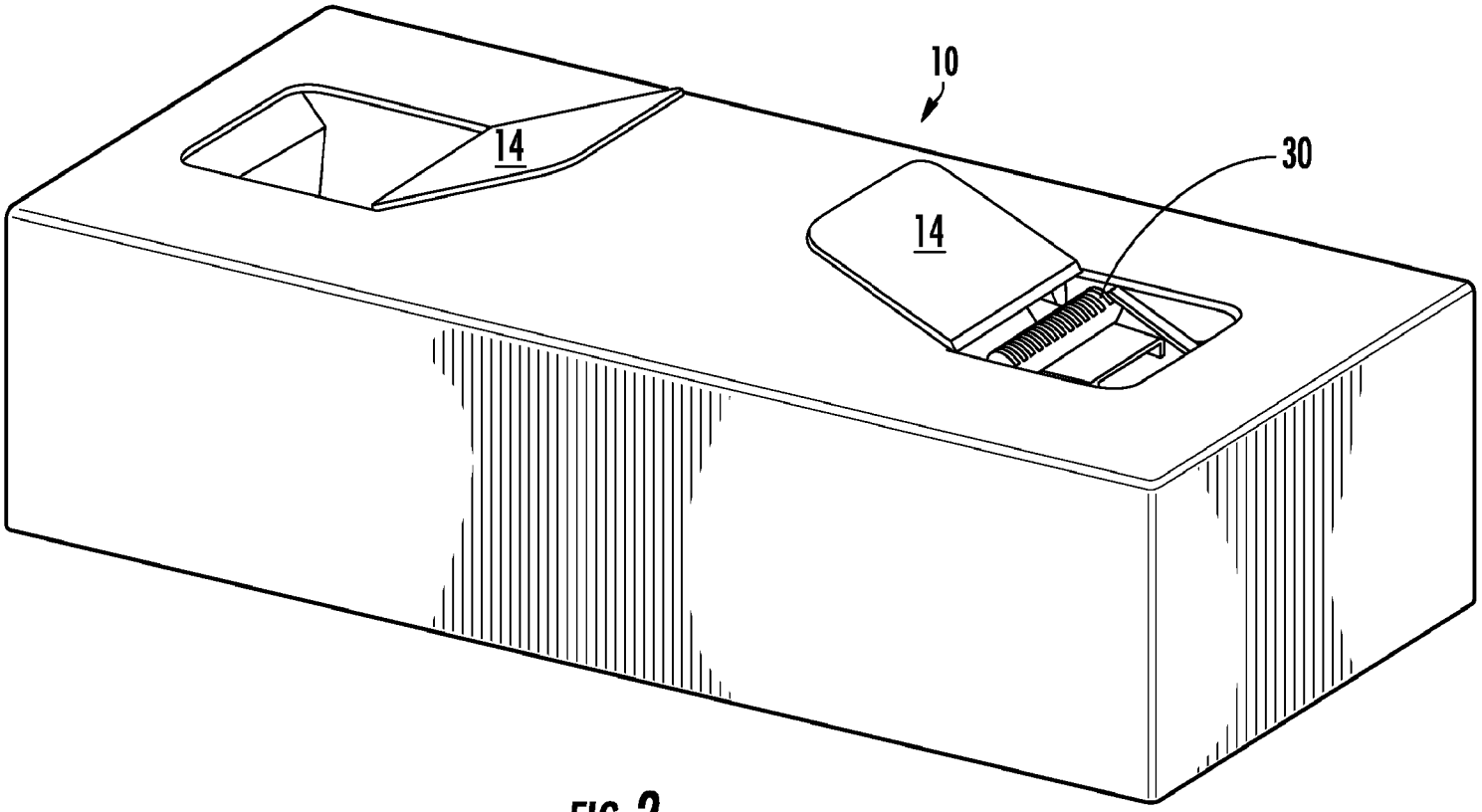
FIG. 2 is a view similar to FIG. 1 showing the perforated tabs extended the above the package along a hinged end of the tabs.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway.

To avoid redundancy, detailed descriptions of much of the apparatus once described in relation to a figure is not repeated in the descriptions of subsequent figures, although such apparatus or process may be an identical or closely related embodiment.

As best seen in reference to FIGS. 1-5 packaging 10 for a heavy article 20 such as a service floor jack is provided. As used herein, a heavy article 20 can include articles greater than 50 pounds and can also include articles of lesser weight but having dimensions such that the use of temporary handles of the article allows for a safer and more comfortable handling and removal of the article from packaging. As seen, perforations 12 can be used to define one or more tabs 14 on an edge wall of a paperboard or corrugated paper container. The perforated tabs 12 can be moved to provide access to handles which are present on the article. In one embodiment of the invention, the handles are temporarily attached to the article and has sufficient flexibility and pliability that they can be accessed and engaged above a surface of the container as seen on FIG. 3 and then returned if needed to within the interior of the packaging.

Temporary handles 30 provide a more comfortable and safer method of grasping the heavy article but does not risk compromising the packaging, providing a consumer with a way of more safely carrying or manipulating the packaged product.

Figure 3:
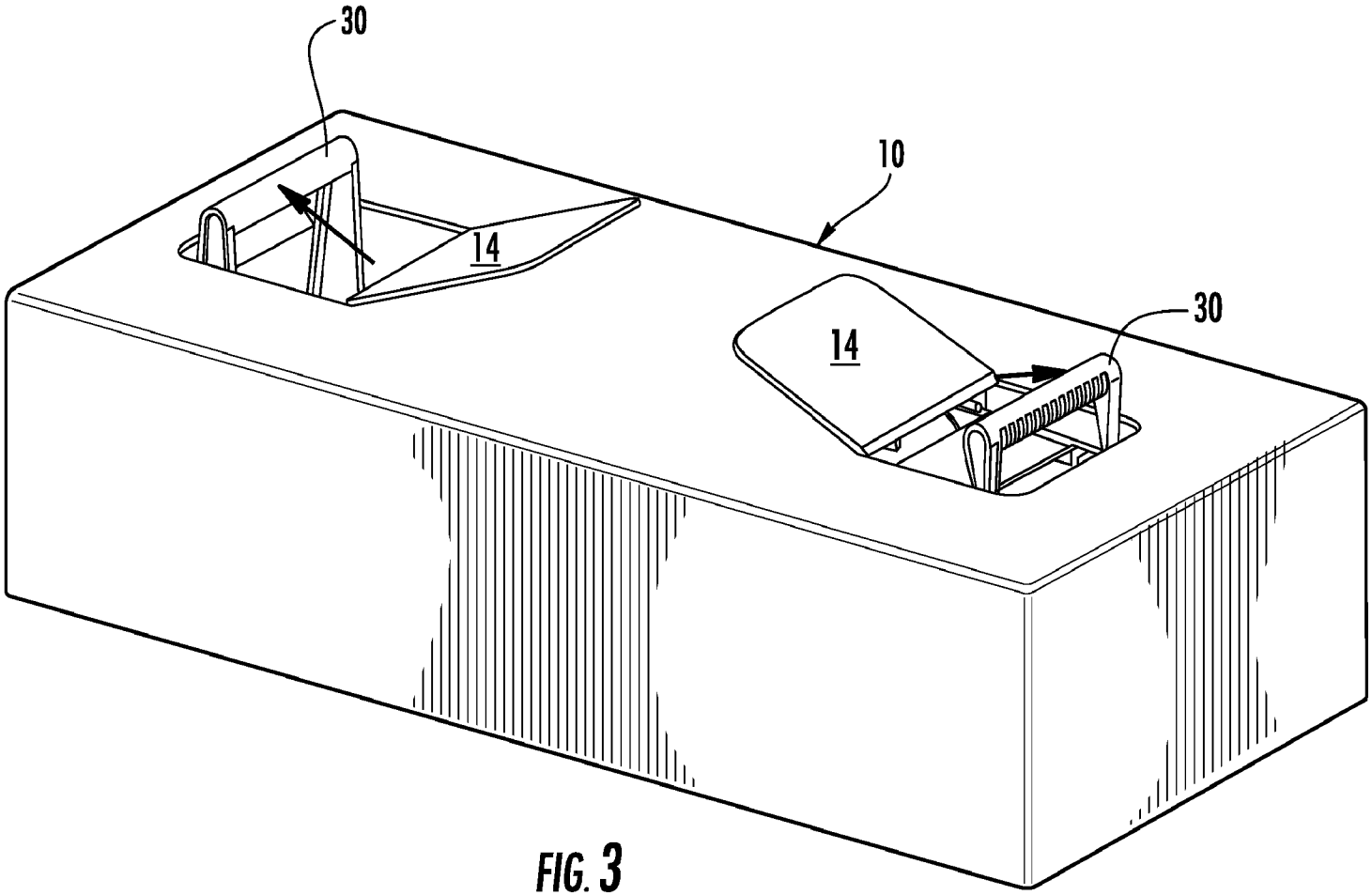
FIG. 3 illustrates handles attached to a floor jack that can be positioned above the jack and extend part way through the container top openings to allow user to grasp the handles.
Figure 4:
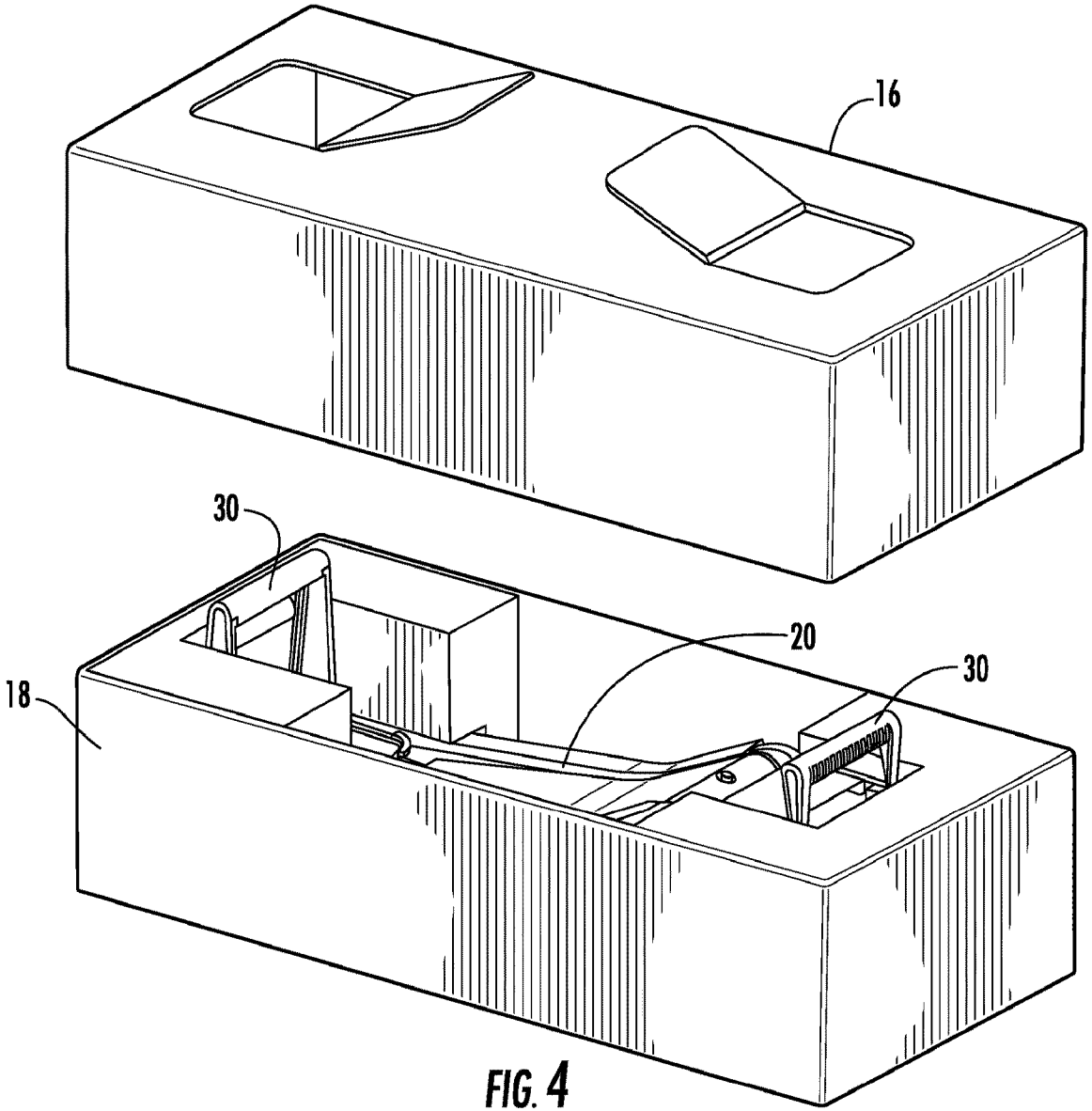
FIG. 4 is an exploded view showing an upper portion of the container which is designed to nest along an exterior of the lower portion of the container and showing handles attached to the floor jack.
Figure 5:
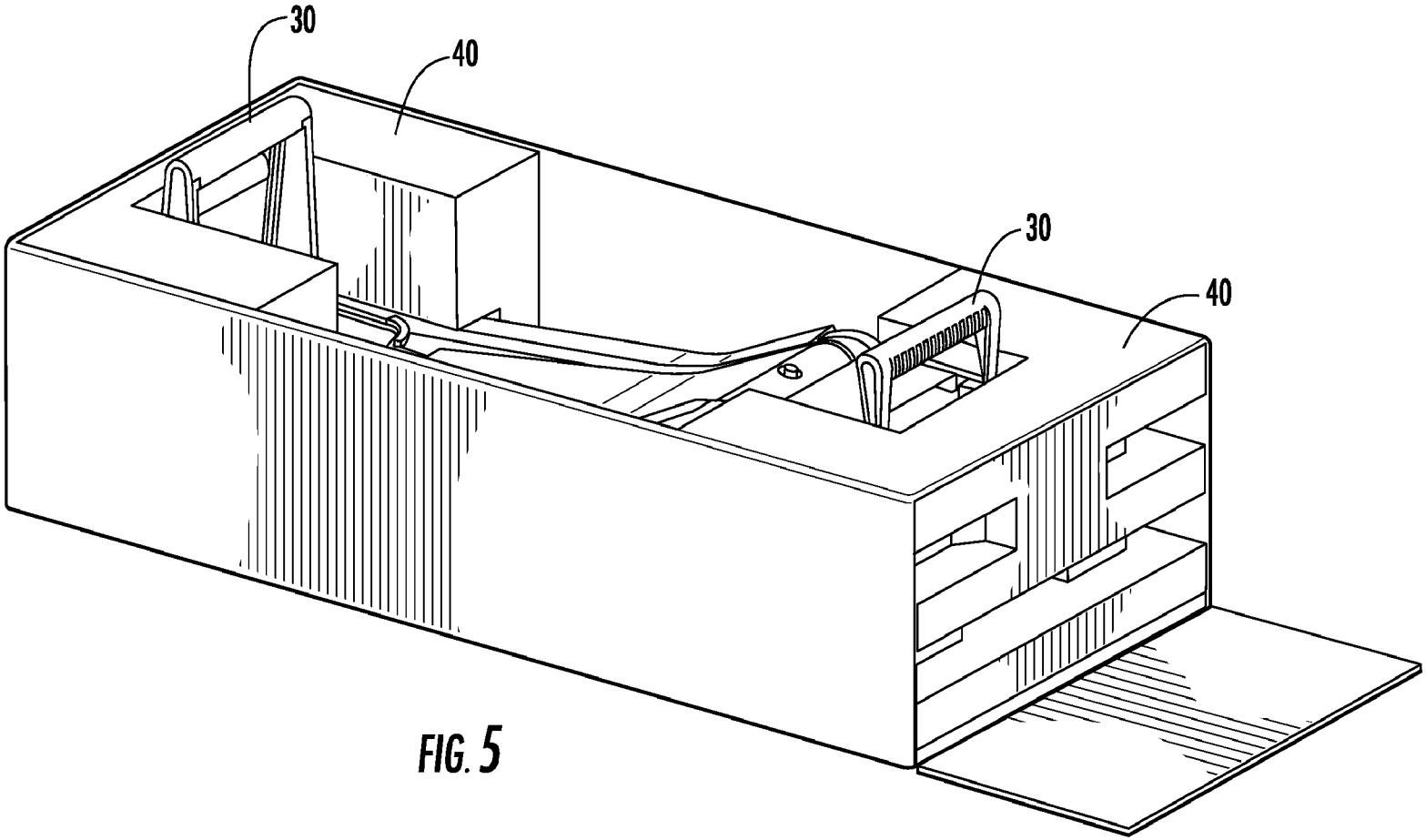
FIG. 5 illustrates a floor jack packaging having one end of the lower container half folded down to be substantially flush with the floor or other flat surface in which the package rests.
Figure 6:
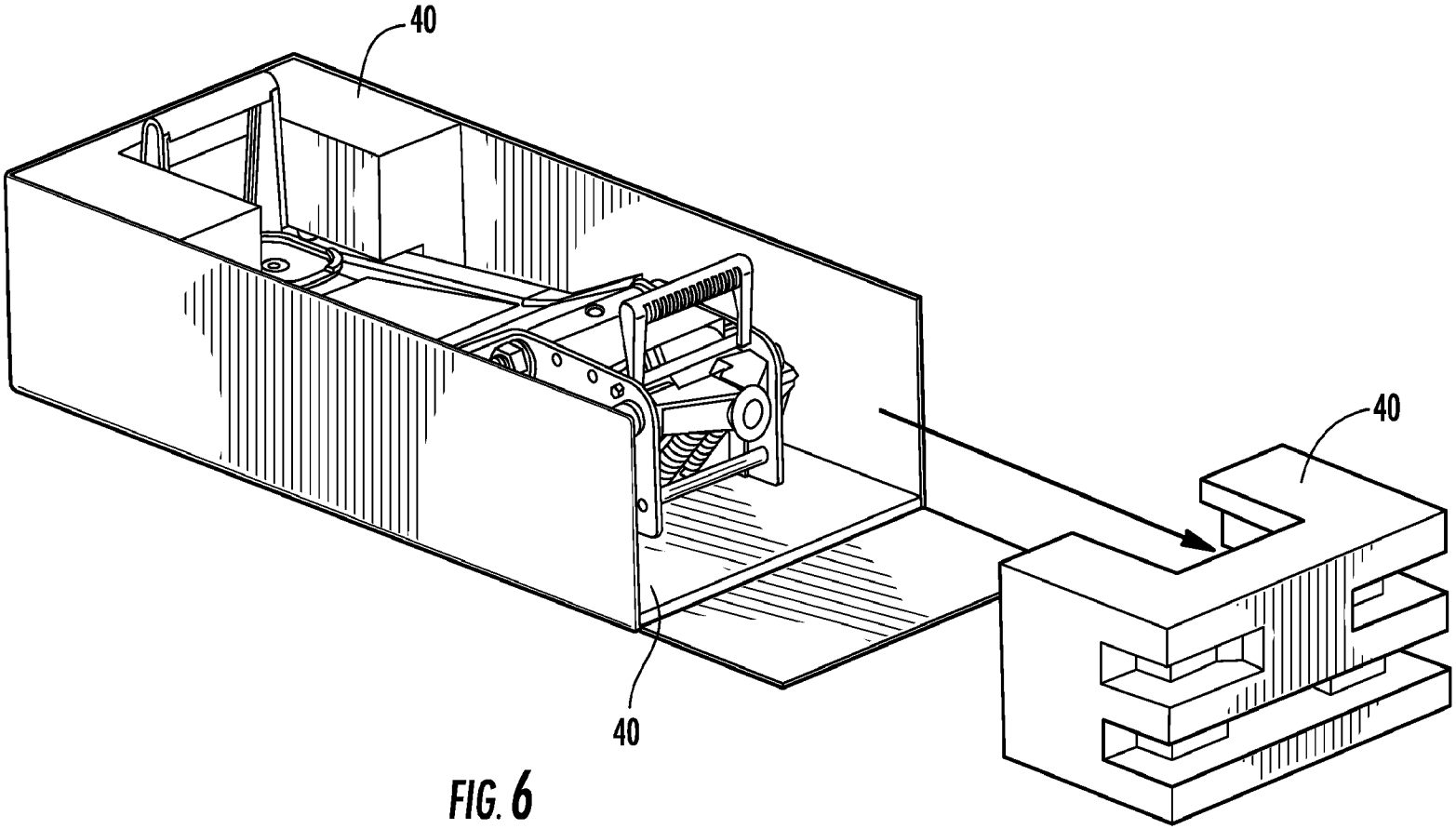
FIG. 6 illustrates packaging in which a protective foam insert can be removed through the open end of the package and allowing access to the floor jack.

As seen in reference to FIG. 4, a telescopic top 16 of the carton, which may have the perforations, can be removed from the packaging bottom 18. As best seen in FIGS. 3 and 5, a pair of handles 30 can be elevated above the surface of the packaging and used to help to manipulate the article from the package. Such removal can include either a vertical dead weight lifting of the article or the handles can be used to remove the article through an end wall opening as seen in FIGS. 5 and 6.

Figure 7:
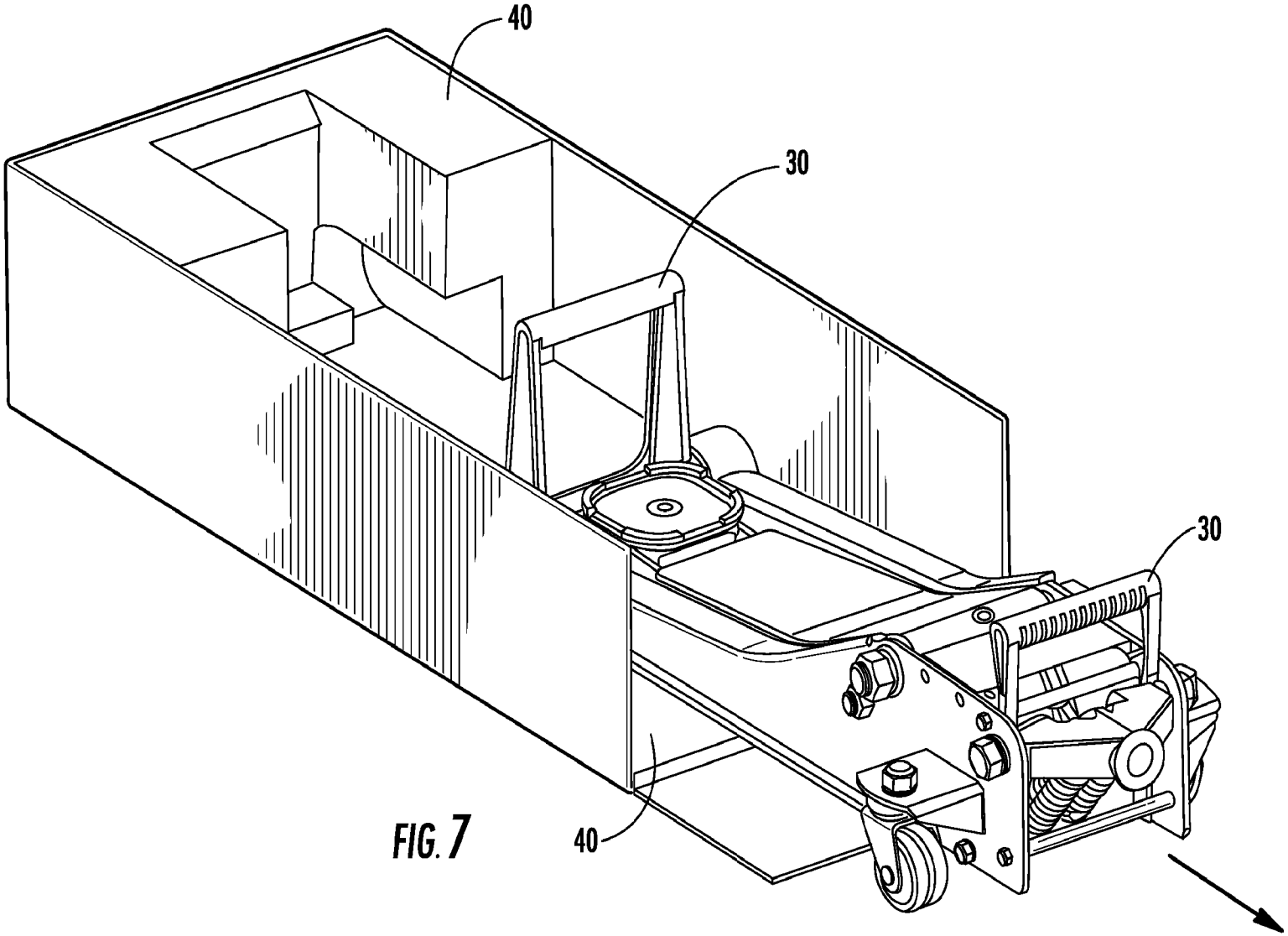
FIG. 7 illustrates a step of rolling the floor jack on the floor jack wheels out of the packaging and without having to lift the jack on the container.
Figure 8:
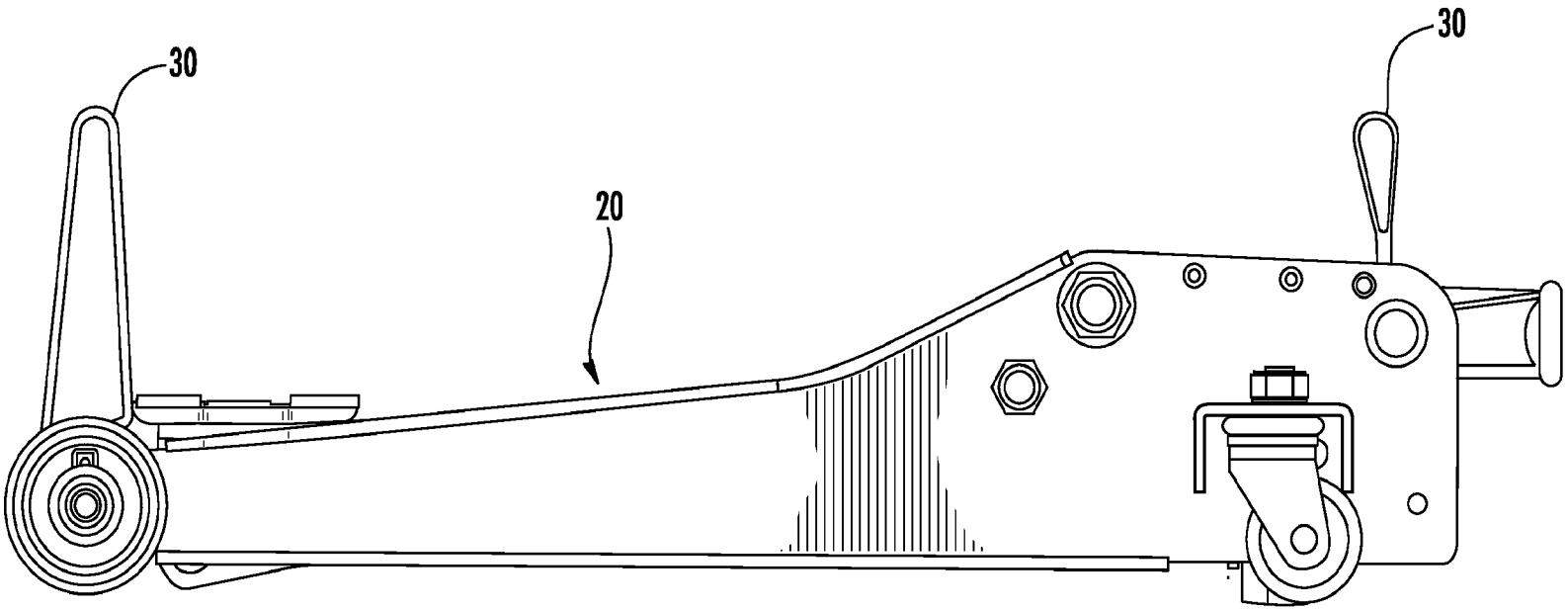
FIG. 8 is a side view of a floor jack showing the two temporary handles that can be installed on the floor jack.
Figure 9:
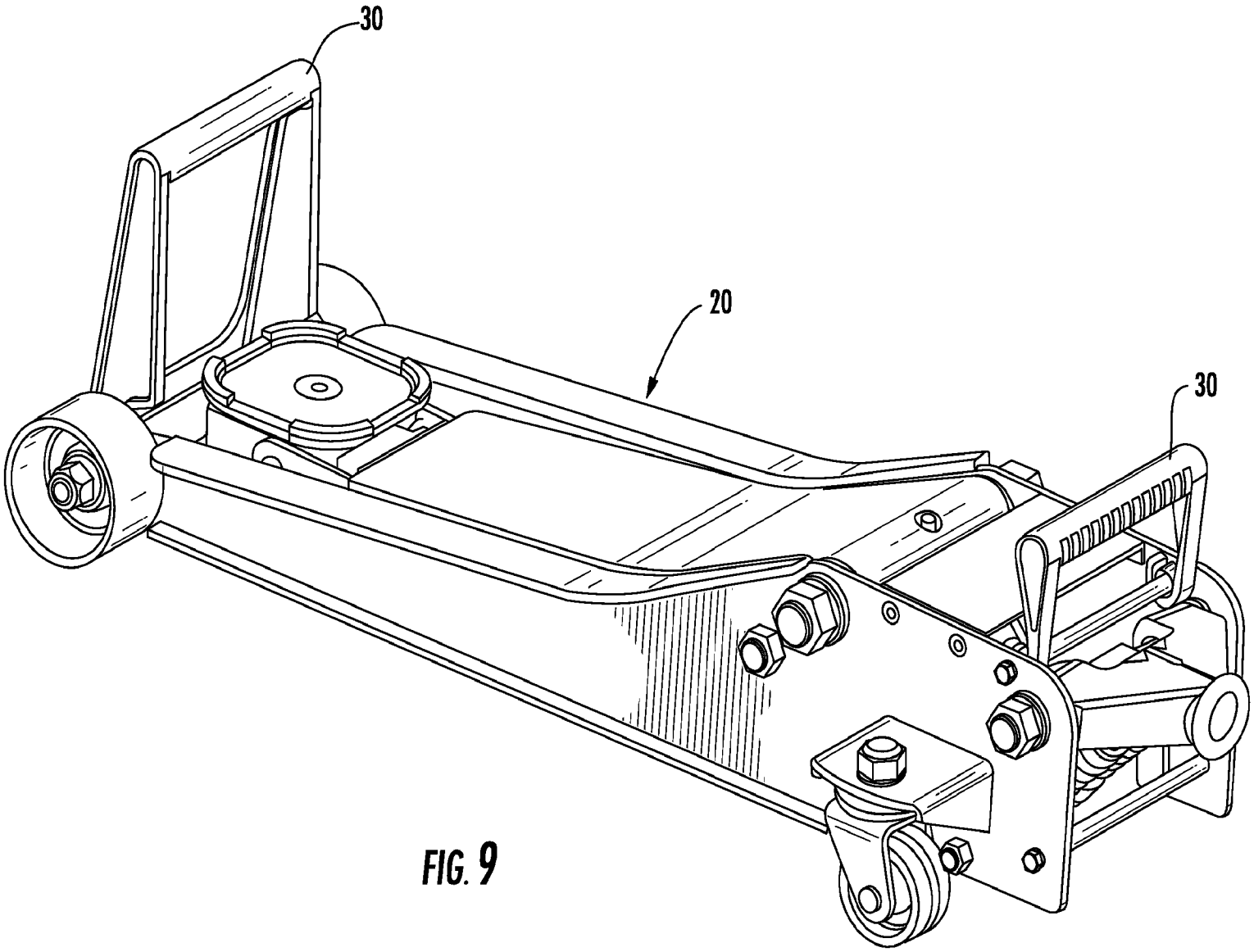
FIG. 9 is an alternative view of the handles installed on the floor jack.
Figure 10:
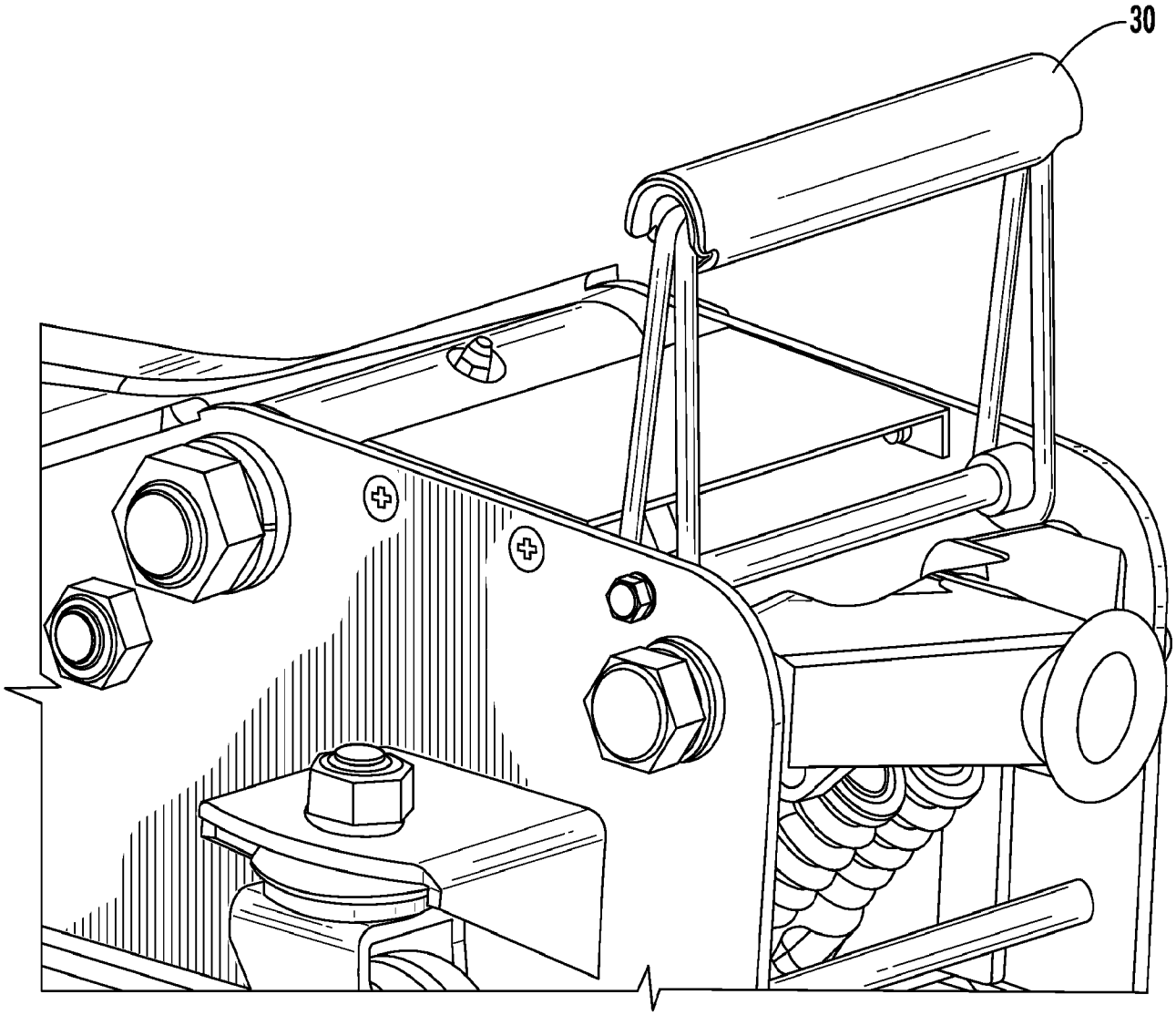
FIG. 10 is a close up of a handle but to be constructed with rope, webbing, or similar connections to a cost member of the floor jack.
Figure 11:
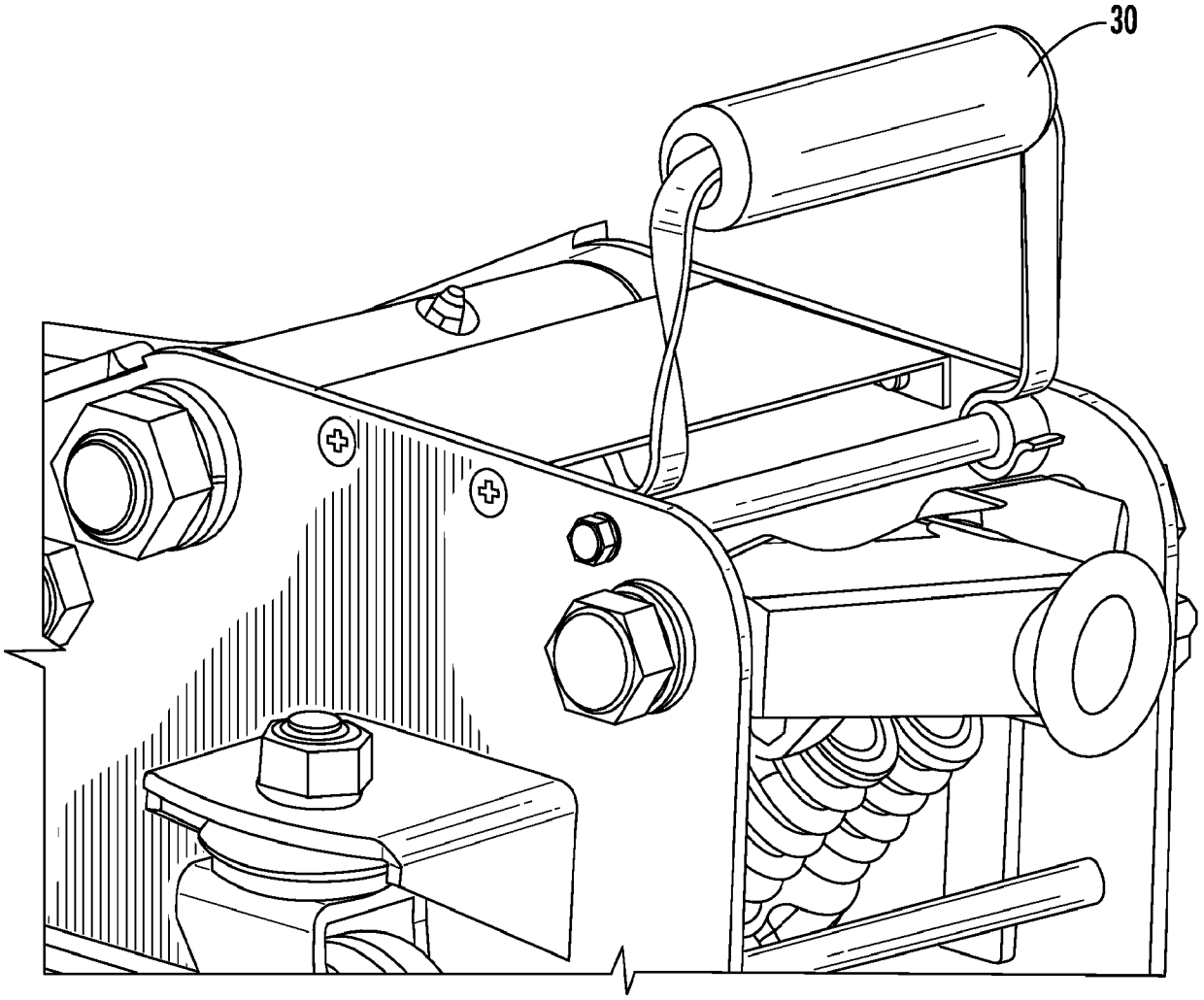
FIG. 11 shows an alternative embodiment of a handle that can be provided from a formed middle or wire connected to a cross member of the floor jack.

As seen in reference to FIG. 7 for a heavy article such as a wheeled floor jack, foam inserts 40 or other packaging material such as paperboard can be easily removed from the article and then the wheels are free to support the article and can be rolled out of the packaging.

As seen on FIGS. 8-11 of the attachment, various locations of temporary handles can be seen in relation to a floor jack. The handles can be attached to cross members that exist in the jack's frame and provide structurally sound lift point for the handles. Handles may be provided from plastic, a rope type material, webbing, metal, wire, and may be of a pliable material or a more rigid material which can be easily hinged and may pivot to rotate relative to the cross member as best seen in reference to FIG. 11.

Figure 12:
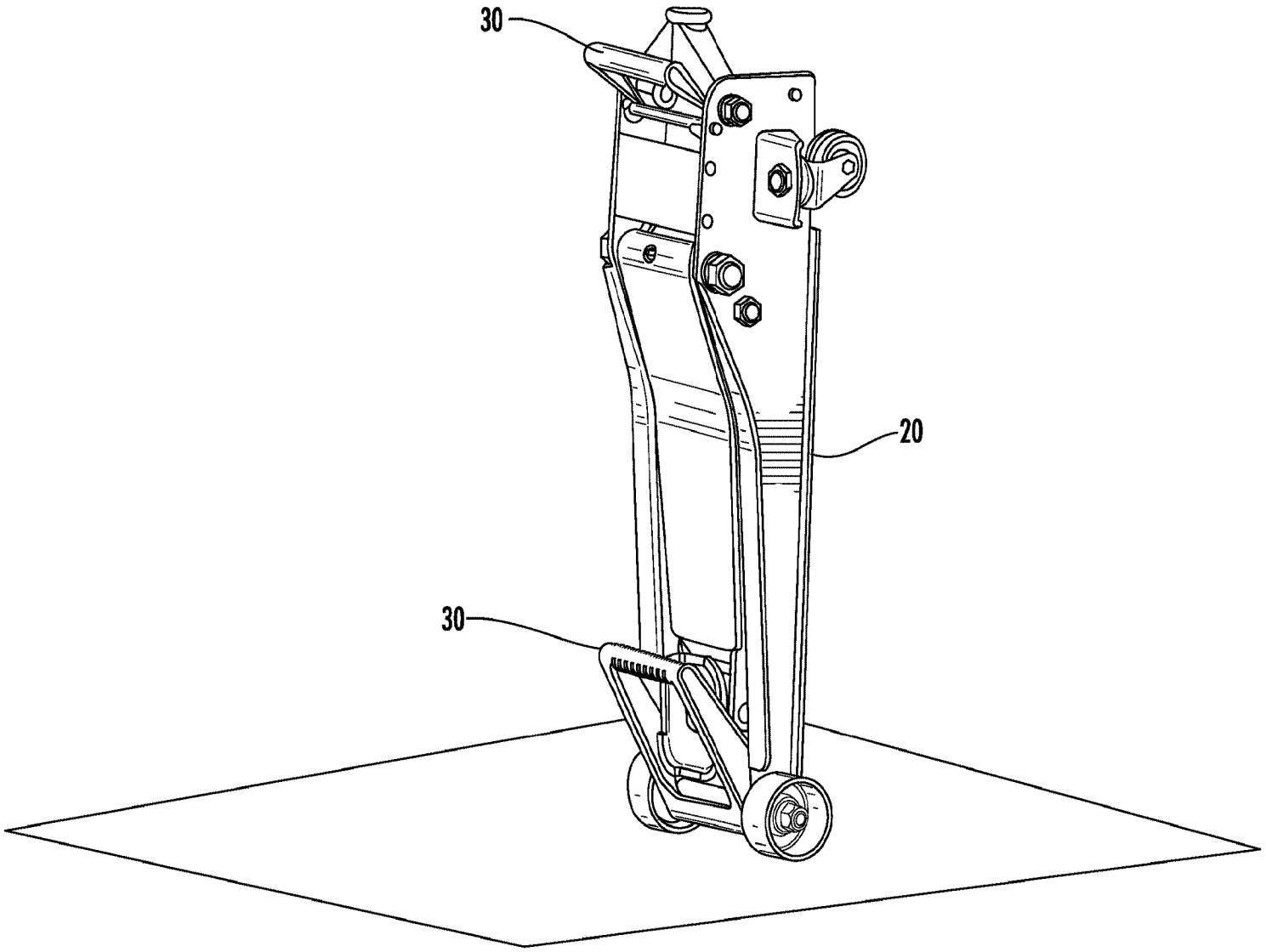
FIG. 12 illustrates how the rear handle of the floor jack can place the floor jack in a vertical position which improves the ergonomics of moving or lifting the jack.

As seen on FIG. 12 a packaged article with the packaging removed for clarity is shown. The packaged article may be easily lifted to be placed in an upright position for display or storage. As the handles can be repositioned the use of the packaging surface, the temporary handles do not require larger packaging size or interfere with the ability to stack or place on pallets the floor jacks or similar heavy equipment.

The present invention has a number of novel features. Such features include but are not limited to the use of temporary handles that are recessed beneath openings in a product packaging, can be used to remove the packaging and then repositioned within the body of the packaging container. An additional aspect of the present invention includes a manufactured article, such as a floor jack, in which the floor jack further comprises at least one temporary handle that can be used for both shipping/handling purposes as well as to facilitate removal of the article from the shipping container. It is a further aspect that the packing can break down to allow the jack to be rolled out of the packaging avoiding a "dead lift" by the customer. It is a further aspect of the present invention to provide for a heavy article, such as a floor jack, in which at least a pair of temporary handles are provided so as to allow for a method and apparatus way of carrying and supporting a heavy article within a package in which the article is safely balanced relative to the two handle locations.

In an aspect, the present invention includes a process of removing a floor jack from a package. The process includes removing a top cover piece from the package containing the floor jack (As illustrated in FIGS. 4 and 5), lowering a flap on a lower piece of the package (As illustrated in FIGS. 5 and 6), removing a cushion insert from the lower piece (as illustrated in FIG. 6), and rolling the floor jack out of the package and over the flap (As illustrated in FIG. 7), wherein the floor jack is removed from the package without having to lift the floor jack from the package.

In another aspect, the present invention includes a process for packaging a floor jack, which generally includes the steps of removing the floor jack being performed in reverse. The process includes supplying a paperboard package comprising a lower half and upper half, the upper half telescopically engaging the lower half. A first cushion member is positioned within a first end of the lower half of the packaging (as illustrated in FIG. 7), and a flap on a second end of the lower half of the packaging is lowered (as illustrated in FIG. 7). The process then includes rolling the floor jack over the flap and into the lower half (as illustrated in FIG. 7), inserting a second cushioning member between the floor jack and the second end (as illustrated in FIG. 6, reversed), closing the flap, and securing the upper half to the lower half (as illustrated in FIG. 4).

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

What is claimed is:

1. A packaging system for a floor jack, the packaging system comprising:

a package including lower and upper halves, wherein the lower half includes first and second ends, and the upper half telescopically engages the lower half to cooperatively form a closed package that is adapted to contain the floor jack, and wherein the upper half includes first and second movable tabs on a top of the upper half, a first removable handle adapted to be removably coupled to the floor jack, wherein the first movable tab is adapted to provide access to the first removable handle and the first removable handle is movable between first and second positions when the first removable handle is coupled to the floor jack and the floor jack is disposed in the closed package, wherein when the first removable handle is in the first position, the first removable handle is disposed below the top and inside the closed package, and when the first removable handle is in the second position, the first removable handle extends through a first opening formed by the first movable tab;

a second removable handle adapted to be removably coupled to the floor jack, wherein the second movable tab is adapted to provide access to the second removable handle and the second removable handle is movable between first and second positions when the second removable handle is coupled to the floor jack and the floor jack is disposed in the closed package, wherein when the second removable handle is in the first position, the second removable handle is disposed below the top and inside the closed package, and when the second removable handle is in the second position, the second removable handle extends through a second opening formed by the second movable tab;

a first cushion member disposed in the lower half proximate to the first end;

a flap coupled to the second end; and a second cushion member disposed in the lower half proximate to the second end.

2. The packaging system of claim 1, wherein the first movable tab is formed by perforations in the upper half.

3. A floor jack packaging system, comprising:

a floor jack;

first and second removable handles removably coupled to the floor jack;

a package including lower and upper halves, wherein the lower half includes first and second ends, and the upper half telescopically engages the lower half to cooperatively form a closed package, and wherein the upper half includes first and second movable tabs on a top of the upper half;

wherein the first and second movable tabs are respectively adapted to provide access to the first and second removable handles, and the first removable handle is movable between first and second positions when the floor jack is disposed in the closed package, wherein when the first removable handle is in the first position, the first removable handle is disposed below the top and inside the closed package, and when the first removable handle is in the second position, the first removable handle extends through an opening formed by the first movable tab;

a first cushion member disposed in the lower half proximate to the first end;

a flap coupled to the second end; and a second cushion member disposed in the lower half proximate to the second end.

4. The floor jack packaging system of claim 3, wherein each of the first and second movable tabs is formed by perforations in the upper half.

* * * * *